United States Patent [19]

Kawai

[11] 3,989,090

[45] Nov. 2, 1976

[54] CORE SUPPLY SYSTEM FOR METAL FOUNDING

[75] Inventor: Takashi Kawai, Tokyo, Japan

[73] Assignee: Hitachi Metals, Ltd., Japan

[22] Filed: Nov. 4, 1974

[21] Appl. No.: 520,911

[30] Foreign Application Priority Data

Nov. 12, 1973 Japan ..... 48-126252

[52] U.S. Cl. ..... 164/228; 164/323; 164/340; 214/16.4 A

[51] Int. Cl.[2] ..... B22C 11/04; B22D 33/04

[58] Field of Search ..... 164/323, 324, 340, 322, 164/273 R, 273 M, 270, 339, 228; 214/16.4 A, 301

[56] References Cited

UNITED STATES PATENTS

| | | | |
|---|---|---|---|
| 453,056 | 5/1891 | Welsh | 164/324 X |
| 1,355,204 | 10/1920 | Wood | 164/228 X |
| 2,570,717 | 10/1951 | Ronceray | 164/324 X |
| 3,049,247 | 8/1962 | Lemelson | 214/16.4 A |
| 3,254,376 | 6/1966 | Burnett | 164/323 |
| 3,416,203 | 12/1968 | Ozenne et al. | 164/340 X |
| 3,448,496 | 6/1969 | Arnold et al. | 164/340 |
| 3,520,424 | 7/1970 | Lemelson | 214/16.4 A |
| 3,633,769 | 1/1972 | Dubinsky et al. | 214/16.4 A |
| 3,888,299 | 6/1975 | Bordet | 164/323 X |

FOREIGN PATENTS OR APPLICATIONS

| | | | |
|---|---|---|---|
| 254,412 | 5/1967 | Austria | 164/322 |

OTHER PUBLICATIONS

"Kasper Conveyorizes Coremaking", Foundry M & T, Nov. 1974, pp. 87, 88, by W. D. Huskonen.

*Primary Examiner*—Ronald J. Shore
*Attorney, Agent, or Firm*—Craig & Antonelli

[57] ABSTRACT

Core conveyor means of the endless type moving synchronously or non-synchronously with one or more continuous casting devices is disposed in side-by-side relation with the continuous casting device or devices, and the conveyor means is moved in the same direction as the molds moving in the continuous casting device or devices. The cores supplied from a core supply source which may be a core making machine, a group of core making machines consisting of two or more core making machines or a core cage stack house with stacker crane are fed through the agency of the core conveyor means to the continuous casting device or devices. By this arrangement, it is possible to supply cores quickly or smoothly or supply large numbers of cores of different types with a high degree of efficiency to the casting device or devices.

6 Claims, 4 Drawing Figures

CORE SUPPLY SYSTEM FOR METAL FOUNDING

Figure 1:
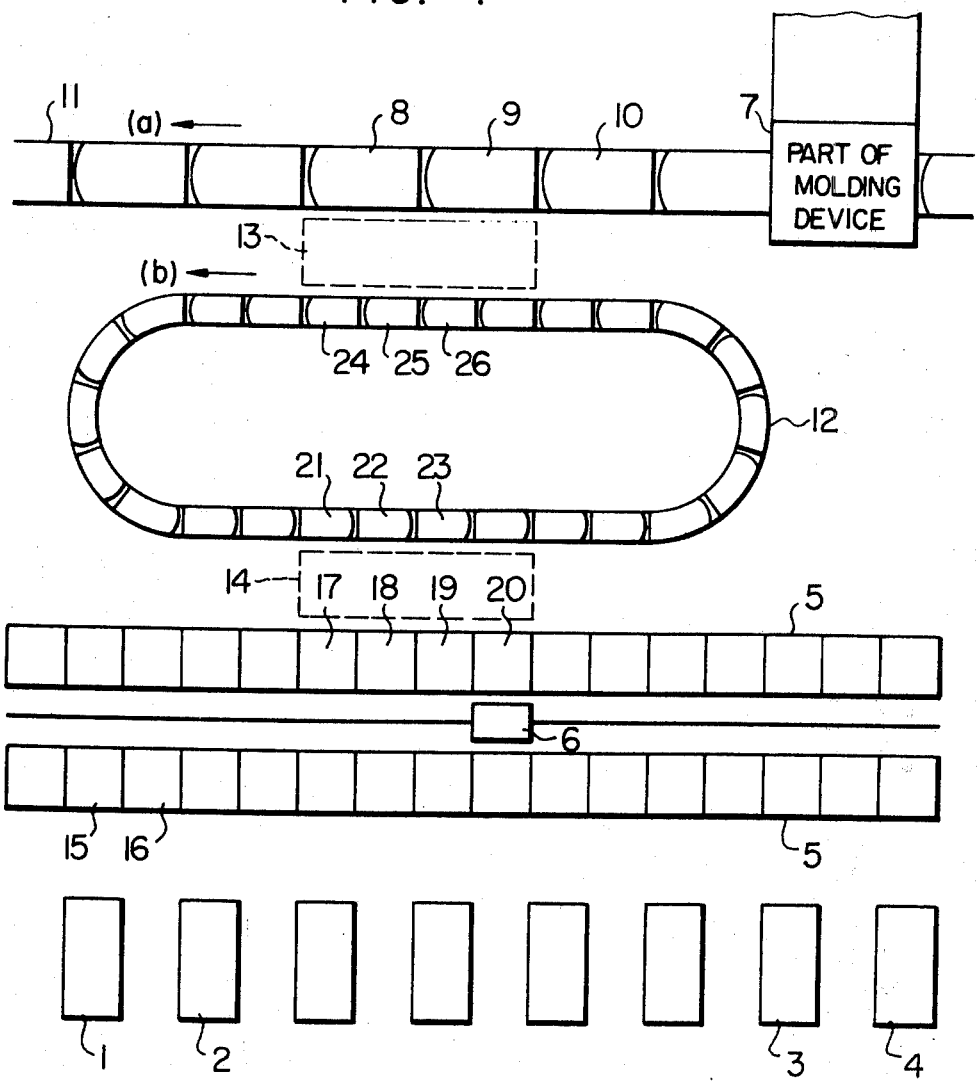

This invention relates to core supply systems for casting devices, and more particularly it is concerned with a core supply system for metal founding which has particular utility with continuous casting facilities.

In recent years continuous casting facilities have grown larger in scale and the speed of their operation have become higher. With this tendency, there has been an increasing demand for a core supply system which enables large numbers of cores of different types to be supplied smoothly to the core setting station of the casting device.

The present practice is to use for a casting device of a large scale a core making machine of a high capacity consistent with the ability of the casting device to produce castings, or to supply cores to the casting device of a large scale by using a group of core making machines consisting of a several or ten-odd core making machines. This makes it necessary to provide core conveyor means between the casting device and the core making machine or the group of core making machines which are consistent with the ability of the device to produce castings.

The cores of different types made by the core making machine or the group of core making machines are not necessarily fed immediately to the casting device; only those cores which are necessary for the molds being formed by the molding machine are selectively fed to the casting device. More particularly, if there is any change in the pattern used in the molding machine, there will be a change in the type of the molds formed. This will cause a change to occur in the type of cores which are required for use with the molds. Thus it becomes necessary to make an alteration in the type of cores fed to the molds.

Moreover, the cores used for carrying out metal founding tend to deteriorate due to absorption of moisture or other chemical changes. This makes it necessary to take measures to render the cores impervious to these influences. It is thus desirable that the cores should be fed directly to the casting device from the core making machine of the group of core making machines by avoiding prolonged storing. However, when the ability of the molding machine to form molds is greater than the ability of core making machine or the core making machines to make the proper types of cores required for the molding machine at the point in time, it will be necessary to provide means for beforehand and temporarily storing the cores, so that the cores of the necessary type can be fed selectively to the molds on the first received, first delivered basis. In this connection, what is important is that no shock should be given to the cores while they are being conveyed, because the cores are generally low in rigidity and easily broken.

Thus what is now required in the metal founding industry is a rational conveyor system which enables large numbers of cores used for metal founding to be fed smoothly to a casting device, particularly a continuous casting device, while maintaining the aforementioned conditions which are complex in nature.

An object of the invention is to provide a core supply system for metal founding which enables a core setting operation to be performed efficiently by selectively supplying to the casting device or devices quickly and smoothly the cores made by a core making machine or a group of core making machines, and which can be constructed at an economically acceptable capital cost.

Another object is to provide a core supply system for metal founding which enables a core setting operation to be performed efficiently by selectively supplying to the casting device or devices quickly and smoothly large numbers of cores of different types which are made beforehand and temporarily stored, and which can be constructed at an economically acceptable capital cost.

The outstanding characteristic of the invention is that core conveyor means of the endless type is arranged in side-by-side relation with one or more casting devices and moved in the same direction as the molds moving in the casting device or devices, so that the cores supplied from a core supply source which may be a core making machine, a group of core making machines consisting of two or more core making machines or a core stack-house with stacker crane or core stack-houses disposed in one or more positions can be fed to the continuous casting device or devices through the agency of the core conveyor means.

Figure 2:
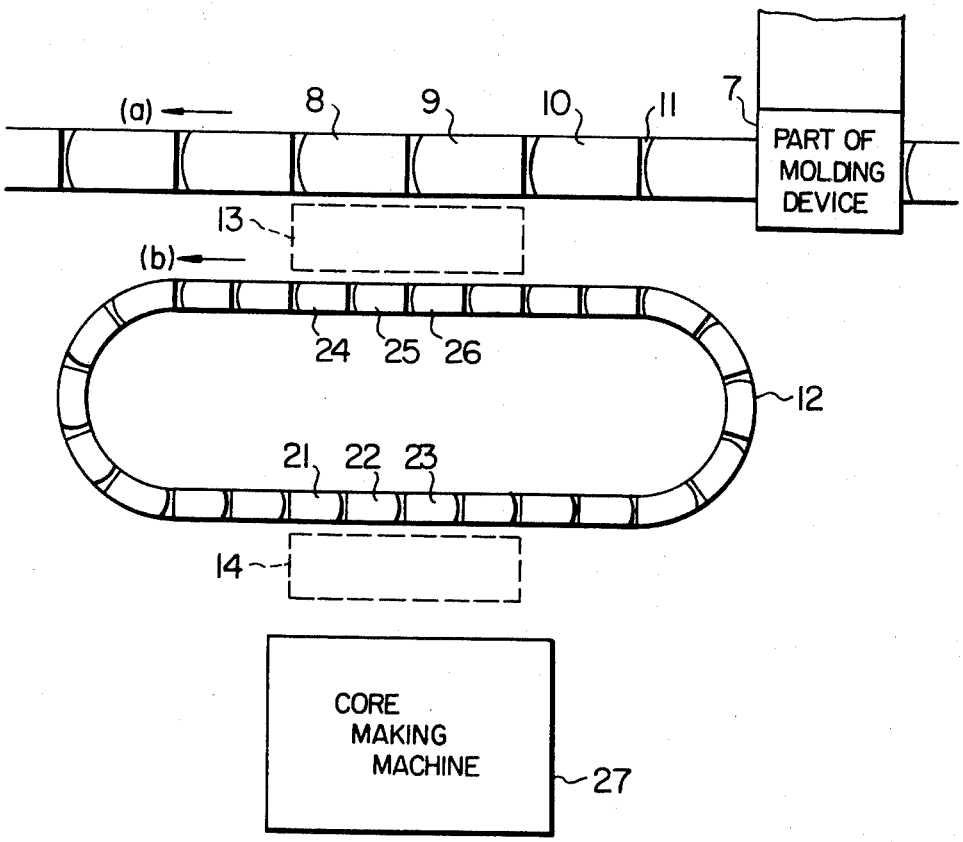
Figure 3:
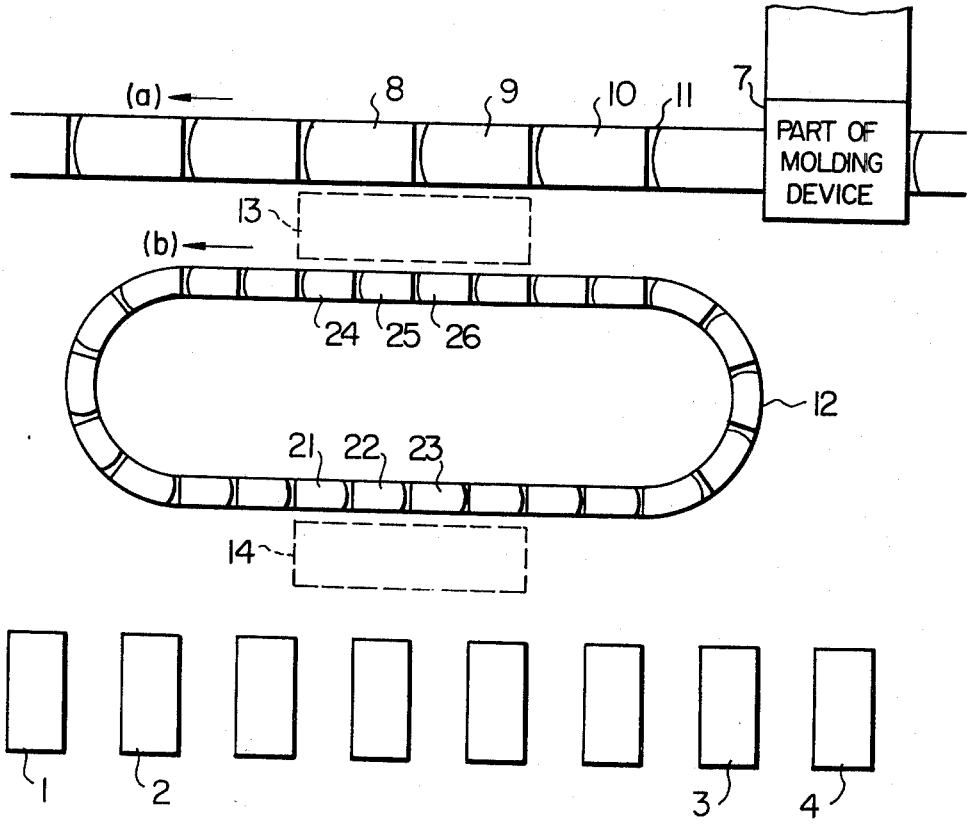
Figure 4:
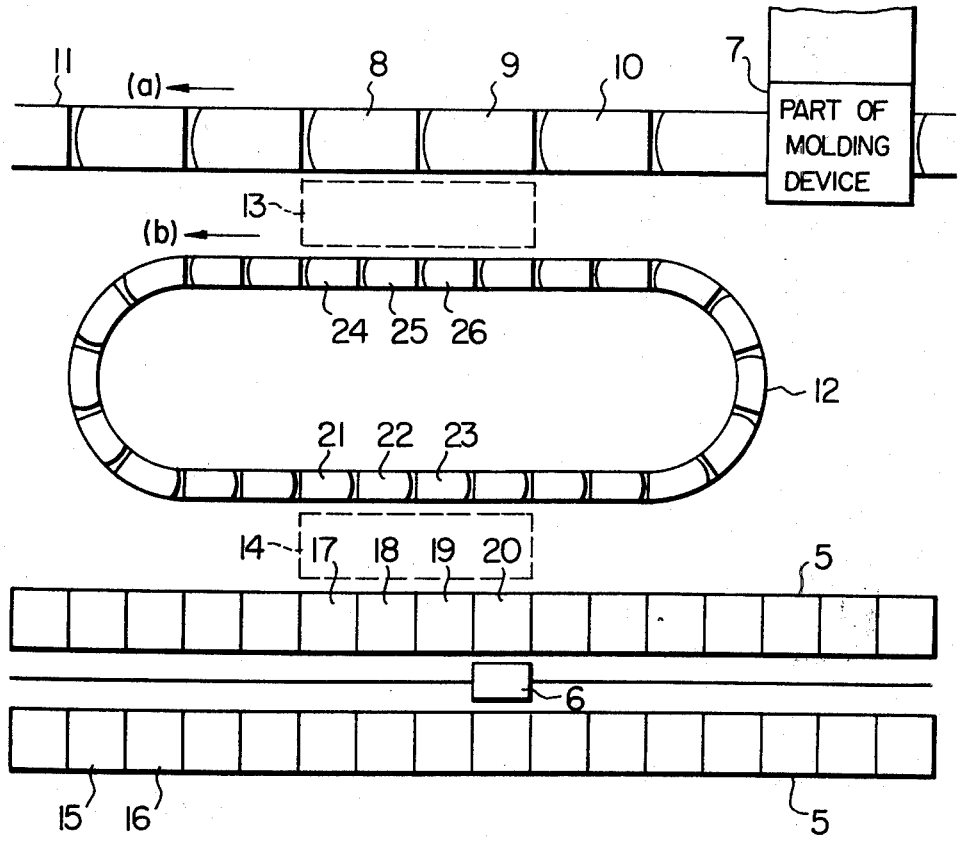

FIG. 1 is a plan view of the core supply system comprising one embodiment of the invention; and FIG. 2 to FIG. 4 are plan views comprising other embodiments of the invention.

The invention will now be described in detail with reference to the drawings.

Referring to FIG. 1, there is shown one embodiment of the invention in which 1, 2, 3 and 4 designate core making machines and 5 designates a stack-house. The stack-house 5 has in its central portion a stacker crane 6 and is provided with many shelves for temporarily placing thereon core cages. Meanwhile drag molds 8, 9 and 10 formed by a part of molding device 7 is conveyed in the direction of an arrow *a* by a mold conveyor 11.

A core conveyor 12 of the endless type is arranged between the mold conveyor 11 and the stack-house 5 and adapted to move in the direction of an arrow *b* synchronously with the mold conveyor 11.

13 refers to a core setting station in which the cores conveyed by the core conveyor 12 are set in the drag molds 8, 9 and 10, while 14 refers to a core supply station for supplying cores from the large stack-house 5 to the core conveyor 12.

The cores made by the core making machines 1, 2, 3 and 4 are put in cages disposed in suitable positions in the stack-house 5. For example, cages 15 and 16 are adapted for use with the cores made by the core making machine 1. When the case 15 is filled with cores, it is moved by the stacker crane 6 and placed on a suitable shelf of the large stack-house where the cores are temporarily stored by suitably classifying them. Meanwhile the cores made while the cage 15 is being moved to the suitable shelf are put in the cage 16. Then the stacker crane 6 moves an empty cage to the position in which the cage 15 was disposed. This process is repeated.

In this way the cages in which different types of cores are put are temporarily stored in the large stack-house 5 by suitably classifying them. At a suitable point in time later on the cages containing therein the types of cores adapted for use with the drag molds 8, 9 and 10 are selected and moved by the stacker crane 6 to positions indicated at 17, 18, 19 and 20. These cores are withdrawn from the cages disposed in the positions 17, 18, 19 and 20 by the operator at the core supply station 14 and placed on pallets 21, 22 and 23. For example, when four types of cores are required for each of the molds 8, 9 and 10, four types of cores are placed on each of the pallets 21, 22 and 23 in suitable numbers after the cores are withdrawn from the cages 17, 18, 19 and 20.

Since the core conveyor 12 moves synchronously with the mold conveyor 11, the pallets disposed in the positions 21, 22 and 23 move to positions 24, 25 and 26. This enables the operator to readily set the cores on the pallet 24 in the drag mold 8 and the cores on the pallet 25 in the drag mold 9 and the cores on the pallet 26 in the drag mold 10 at the core setting station 13.

It will be appreciated that the core setting operator positioned between the mold conveyor 11 and the core conveyor moving synchronously with each other can handle the required cores in a most suitable position and has only to move a minimum distance in handling them.

In the aforementioned description, the core conveyor 12 has been described as moving synchronously with the mold conveyor 11. It is to be understood that according to the invention similar results can be achieved even if the two conveyors do not move synchronously. When the numbers of cores supplied to one pallet of the core conveyor 12 are M times as great as that of the cores to necessitate for one mold, the speed of movement of the core conveyor 12 is made to be 1/M of that of the mold conveyor 11. This enables the numbers of the supplied cores to be balanced with that of the cores to necessitate.

Other embodiments of the invention will now be described. In the system shown in FIG. 2, cores made by a core making machine 27 are successively placed on pallets 23, 22, 21 . . . of the core conveyor 12 by the operator positioned at the core supply station 14 immediately after they are made, and the cores are set in the drag molds 8, 9, 10 . . . in the same manner as described with reference to the embodiment shown in FIG. 1 by the operator positioned in the core setting station 13. When this system is employed, the cores are set in the molds soon after they are made and deterioration of the cores can thus be avoided.

In the system shown in FIG. 3, cores made by a number of core making machines 1 to 4 are supplied to the drag molds 8, 9, 10 . . . through the core conveyor 12 in the same manner as described with reference to the embodiment shown in FIG. 2. This embodiment achieves results similar to those achieved by the embodiment shown in FIG. 2.

In the system shown in FIG. 4, cores made in other place are temporarily stored in the stack-house and supplied to the drag molds 8, 9, 10 . . . through the core conveyor 12 in the same manner as described with reference to the embodiment shown in FIG. 1. This embodiment is suitable for smoothly supplying large numbers of cores of different types to the casting device.

From the foregoing description, it will be appreciated that by means of the invention it is possible to increase operation efficiency, improve the quality of the castings produced and obtain many other advantages.

The advantages gained by working the invention will be listed hereinafter.

1. The desired cores can be supplied quickly and smoothly to a casting device or devices.

2. The desired cores of different types can be supplied in large quantities to a casting device or devices.

3. Since the desired cores are arranged in suitable positions at all times, the core setting operator can concentrate on the operation of setting the cores in molds which should be performed with a high degree of precision. This is conducive to improved quality of the castings produced.

4. The smooth operation of continuous casting facilities can be ensured in view of the advantages offered by the invention which are listed in the preceding three paragraphs.

5. It is possible, when the occasion demands, to carry out inspection, readjustments, washing and assembling of the cores while being conveyed by the core conveyor.

6. The use of a stack-house in combination with a core conveyor reduces the floor space area required for storing, arranging and transferring large numbers of cores to a level which is a fraction of the floor space area required in the prior art.

7. By effecting control of the stacker crane for the stack-house by means of a computer and automating the transfer of the cores to the core conveyor, it is possible to minimize the use of manpower or to rely on computer application for effecting control of the process of making, storing and supplying of the cores.

8. It is possible to safely and quickly arrange, store and move the cores which are relatively low in rigidity and easily broken.

9. By carrying out the storing and delivery of the cores on the first received, first delivered basis, it is possible to readily control the storing of the cores so that their storing may not exceed the limit of the period specified for them.

I claim:

1. A core supply system for metal founding wherein core conveyor means of the endless type and at least one core stack-house are arranged between one or more continuous casting devices and one or more core making machines, said core conveyor means of the endless type being located side-by-side adjacent said one or more continuous casting devices and moving in the same direction as molds moving in said continuous casting device or devices, said at least one core stack-house being located adjacent said one or more core making machines and having a stacker crane and being provided with a multitude of cages.

2. A core supply system for metal founding as claimed in claim 1, wherein said at least one core stack-house is located in two or more positions and said stacker crane is interposed between the adjacent core stack-houses.

3. A core supply system for metal founding as claimed in claim 1, wherein said core conveyor means of the endless type moves synchronously or non-synchronously with the molds moving in said continuous casting device or devices.

4. A core supply system for metal founding wherein core conveyor means of the endless type is arranged between one or more continuous casting devices and at least one core stack-house, said core conveyor means of the endless type being side-by-side adjacent to and moving in the same direction as molds moving in said continuous casting device or devices, said at least one core stack-house having a stacker crane and being provided with a multitude of cages.

5. A core supply system for metal founding as claimed in claim 4, wherein said at least one core stack-house is located in two or more positions and said stacker crane is interposed between the adjacent core stack-houses.

6. A core supply system for metal founding as claimed in claim 4 wherein said core conveyor means of the endless type moves synchronously or non-synchronously with the molds moving in said continuous casting device or devices.

* * * * *